United States Patent [19]

Ishida et al.

[11] 4,424,785

[45] Jan. 10, 1984

[54] FUEL FEED SYSTEM FOR AN INTERNAL COMBUSTION ENGINE

[75] Inventors: Takashi Ishida, Ohi; Noboru Tominari, Tokyo, both of Japan

[73] Assignee: Mikuni Kogyo Kabushiki Kaisha, Tokyo, Japan

[21] Appl. No.: 400,636

[22] Filed: Jul. 22, 1982

[30] Foreign Application Priority Data

Jul. 29, 1981 [JP] Japan ..... 56-117834

[51] Int. Cl.[3] ..... F01B 25/08; F02D 28/00

[52] U.S. Cl. ..... 123/479; 123/399; 123/400; 123/478

[58] Field of Search ..... 123/479, 478, 399, 400

[56] References Cited

U.S. PATENT DOCUMENTS

| | | | |
|---|---|---|---|
| 3,834,361 | 9/1974 | Keely | 123/479 |
| 4,168,679 | 9/1979 | Ikeura et al. | 123/399 |
| 4,310,889 | 1/1982 | Iwai et al. | 123/479 |
| 4,359,028 | 11/1982 | Riala | 123/399 |
| 4,359,991 | 11/1982 | Stumpp et al. | 123/478 |
| 4,389,994 | 6/1983 | Denz et al. | 123/478 |
| 4,398,515 | 8/1983 | Canup et al. | 123/478 |

FOREIGN PATENT DOCUMENTS

| | | | |
|---|---|---|---|
| 17107 | 9/1980 | European Pat. Off. | 123/479 |

*Primary Examiner*—Raymond A. Nelli
*Attorney, Agent, or Firm*—Owen, Wickersham & Erickson

[57] ABSTRACT

A fuel feed system of a fuel priority type for an internal combustion engine. The fuel feed system of the invention has a small auxiliary control unit with no calculation function in addition to a main control unit. When the main control unit malfunctions or is out of order, it is changed over to the auxiliary control unit which insures injection, for instance, at a constant air fuel ratio and in proportion to the degree of movement of an accelerator pedal. Therefore, even when the main control unit is out of order, the driver can drive his vehicle safely to a service station, etc., without stopping the engine. When the main control unit is in a normal state, the main control unit performs engine air control (EAC) at a variable air fuel ratio in the entire range of operation.

8 Claims, 5 Drawing Figures

FUEL FEED SYSTEM FOR AN INTERNAL COMBUSTION ENGINE

BACKGROUND OF THE INVENTION

1. Field of the Invention

The present invention relates to a fuel feed system for an internal combustion engine.

2. Description of the Prior Art

A carburetor or an electronic fuel injection system (EFI) is used as a means for controlling the ratio of air and fuel supplied to an internal combustion engine. In either of them, the amount of air is determined as an initial value on an independent or priority basis, and the amount of fuel suitable therefor is determined dependently thereon. In such an air priority system (EFC), it is not easy to obtain compatibility between fuel economy and emission concentration. For instance, if the amount of air is changed in a substantially stepped manner by the operator (driver), there is a response delay on the part of fuel because fuel has a larger density than air. In a state of acceleration, the pressure difference between portions before and after a throttle valve is very large and much air flows in momentarily. In such a case, compensation is necessary to keep the mixture of air and fuel combustible within a combustion chamber. The inventors herein have already provided a fuel feed system of a fuel priority (engine air control) type, in which outputs from control elements, such as a fuel command potentiometer for detecting the degree of movement of an accelerator pedal, an air flow sensing device within an intake bore and a potentiometer connnected to a throttle valve actuator, and electric signals from compensation elements sensing engine cooling water tenperature, engine cylinder head temperature, atmospheric temperature, atmospheric pressure, fuel feed line pressure, etc., are put into a control unit and compared thereby with memories programmed in advance on the basis of the functional relations between the parameters of said control elements and compensation elements, the throttle valve being actuated on the basis of a required amount of air calculated from fuel flow input so as to give an optimum amount of air. In such a fuel priority system, a required air fuel ratio can be obtained with little delay both in the rise and fall of fuel, and the air fuel ratio can be selected easily and programmed. Particularly in urban areas in which motor vehicles are forced to repeat acceleration and deceleration frequently, the total fuel consumption is much reduced and emission control is facilitated. However, in said fuel priority system, if the throttle valve actuator or the control unit fails to operate properly from one cause or another, the engine will stop and the vehicle cannot run by itself.

BRIEF SUMMARY OF THE INVENTION

It is an object of the invention to provide a fuel feed system of a fuel priority type, adapted to prevent the vehicle from stopping on the road even when a main engine control unit fails to operate properly.

It is another object of the invention to provide a fuel feed system for an internal combustion engine which has an auxiliary control unit in addition to the main control unit so as to ensure the safety of the whole system.

It is a further object of the invention to provide a fuel feed system which can ensure the minimum running of the vehicle by means of the auxiliary control unit.

According to the present invention, a fuel feed system is provided having a small auxiliary control unit with no calculation function in addition to a main control unit. When the main control unit is out of order, it is changed over to the auxiliary control unit which insures injection, for instance, at a constant air fuel ratio and in proportion to the degree of movement of an accelerator pedal. When the main control unit is in a normal state, the main control unit performs engine air control (EAC) at a variable air fuel ratio in the whole range of operation.

In engine control by means of a computer, the malfunction of a mechanical device, such as an actuator or injector, will become apparent by the fact that even when the throttle valve is open at a certain angle, the rotational frequency of the engine is reduced and a pressure difference between portions before and after the throttle valve at the time of actual operation is much different from an expected pressure difference. A malfunction of the computer (main control unit) will become apparent when the actual pressure difference is much different from the expected pressure difference and an optimum air fuel ratio is not maintained. In accordance with the present invention, if the computer (main control unit) is out of order, it is immediately changed over to the auxiliary control unit. The auxiliary control unit memorizes the relations between three parameters consisting of the rotational frequency of the engine, the opening angle of the throttle valve and the required amount of fuel, or maintains the functional relations therebetween by means of an electric circuit, so as to insure a minimum running operation, that is, a low output operation by a limited operation mode according to the degree of pressing of the accelerator pedal. By such an operation, the driver can drive his vehicle to a service station, parking area, etc., without stopping the engine.

The main control unit is manually changed over to the auxiliary control unit when the main control unit or the main throttle valve actuator is defective or out of order. Alternatively, the auxiliary control unit may function to check the condition of the main control unit, for instance, by calculating estimated control values from present control values and output values of various sensors and comparing the estimated control values with the present control values, and to give a warning or to effect an automatic changeover when the estimated control values are different from the present control values. The system may have two fuel injectors, one for the main control unit and the other for the auxiliary control unit, or the same fuel injector may be used for both the main and auxiliary control units.

Other objects, advantages and features of the invention will become apparent from the following detailed description provided in conjunction with the accompanying drawing.

DETAILED DESCRIPTION OF THE PREFERRED EMBODIMENTS

Figure 1:
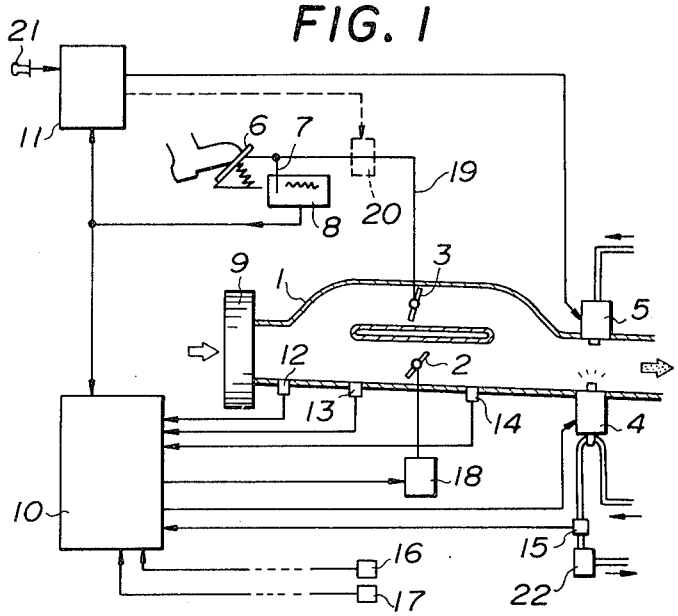
FIG. 1 is a diagrammatic illustration of a fuel feed system of the present invention.

With reference to the drawing, FIG. 1 illustrates an embodiment in which the middle of an intake conduit 1 is divided into two portions respectively provided with a main throttle valve 2 and an auxiliary throttle valve 3, and a main injector 4 and an auxiliary injector 5 are disposed downstream from the throttle valves so as to face each other. The main injector 4 is not necessarily a single-point injection type but may be a multi-point injection type attached within an intake manifold.

The movement of an accelerator pedal 6 by the operator (driver) is transmitted through a linkage 7 to a fuel command potentiometer 8, and output voltage corresponding thereto is delivered to a main control unit 10 and an auxiliary control unit 11.

Figure 4:
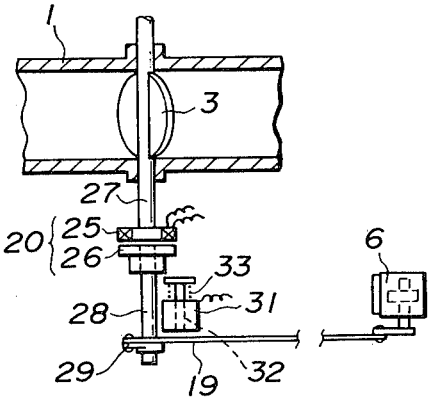
FIG. 4 is a side view of a throttle valve clutch.
Figure 5:
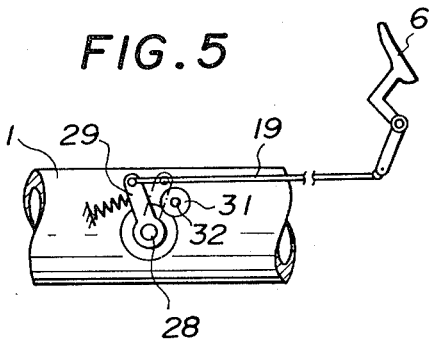
FIG. 5 is a plan view of the same.

Within said intake conduit 1, an intake air temperature sensor 12 is disposed downstream from an air cleaner 9, and pressure sensors 13 and 14 forming an air flow sensing device are disposed upstream and downstream from the main throttle valve 2. This air flow sensing device detects air flow through the pressure difference between portions before and after the throttle valve 2. Alternatively, the sensing device may detect air flow through its electric output which is in proportion to air intake or by utilizing frequency changes based on fluid density and caused by Karmam's vortex street, supersonic wave, etc. In addition to said intake air temperature sensor 12, a fuel supply pressure sensor 15, an engine cooling water temperature sensor 16, an engine rotational frequency sensor 17, etc. are also used as compensation elements. The main control unit 10 receives outputs from the fuel command potentiometer 8, the air flow sensors 13 and 14, and a potentiometer or encoder connected to a throttle valve actuator 18, as well as electric signals from said various compensation elements. The main control unit 10 compares the information with pre-programmed memories and drives the actuator 18, such as a DC servomotor or a stepping motor, on the basis of a necessary amount of air calculated from fuel flow input so that the throttle valve 2 ensures an optimum amount of air. In this case, the auxiliary throttle valve 3 may be connected through a rod 19 with the accelerator pedal 6, as shown in FIG. 5, so as to be driven thereby, or a coupling device 20 such as a clutch, as shown in FIG. 4, which is actuated when the auxiliary control unit 11 operates, may be disposed between the auxiliary throttle valve 3 and the accelerator pedal 6.

In the system illustrated in FIG. 1, when the main control unit 10 is in normal operation, an optimum mixture of air and fuel is supplied to the engine, the air-fuel ratio thereof being variable according to the operational condition of the engine. If the actuator 18 or the main control unit 10 malfunctions for one reason or another, an alarm is activated. Then, the operator deenergizes the main control unit 10 and actuates the auxiliary control unit 11 by means of a switch 21. Alternatively, the auxiliary control unit 11 may contain means for checking the condition of the main control unit 10, said auxiliary control unit 11 being adapted to automatically take the place of the main control unit 10 when the main control unit 10 shows any abnormality. In either case, when there is such abnormality, the output of the potentiometer 8 corresponding to the movement of the accelerator pedal 6 is given to the auxiliary control unit 11 so as to actuate the auxiliary injector 5 and open the auxiliary throttle valve 3 through the clutch 20. As shown in FIGS. 4 and 5, the clutch 20 comprises a solenoid 25 attached to one end of a throttle valve shaft 27 and a disc 26 of a magnetic material attached to the opposing end of a shaft 28 which is disposed in alignment with said throttle valve shaft 27. When excited, the solenoid 25 electromagnetically attracts the disc 26 so as to unite the two shafts 27 and 28 with each other. A lever 29 is fastened to the other end of said shaft 28, and the end of the lever 29 is connected through said rod 19 with the end of the working arm of the accelerator pedal 6. A plunger 32 is axially movably disposed within the range of turning of the lever 29. At the same time that the aforesaid clutch 20 is actuated, a solenoid 31 for the plunger 32 is excited so as to protrude the plunger 32 against the force of a spring 33 to limit the turning angle of the lever 29 to 30° for instance. Thus, when the main control unit 10 is out of order, the plunger 32 prevents the accelerator pedal 6 from being pressed deep so as to keep the opening angle of the auxiliary throttle valve 3 suitable for a low-speed operation. In such a state, the auxiliary control unit 11 sends signals corresponding to the opening angle of the auxiliary throttle valve 3 to the auxiliary injector 5, and therefore, a limited operation mode is maintained. Thus, the air fuel ratio for the low-speed operation is controlled by sensing the opening angle of the auxiliary throttle valve 3, the rotational frequency of the engine and the amount of fuel. Consequently, the driver can drive his vehicle to a service station, etc., by a low-output operation without stopping the engine.

Figure 2:
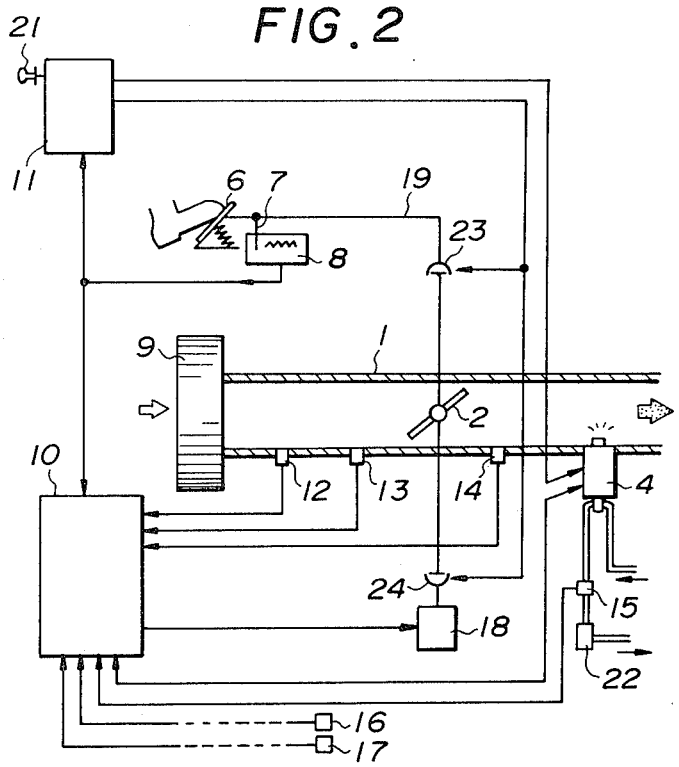
FIGS. 2 and 3 are diagrammatic illustrations of modifications thereof.
Figure 3:
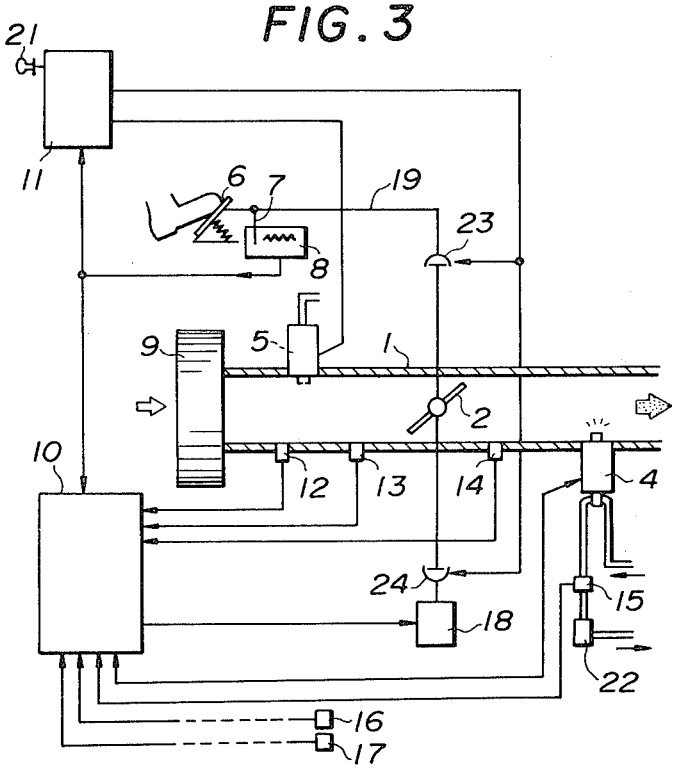

FIG. 2 illustrates another embodiment of the invention. Here the intake conduit 1 is not divided, and has a single throttle valve 2. The shaft of the throttle valve 2 is provided at both its ends with clutches 23 and 24. The clutch 23 is connected with a rod 19 which is connected with the accelerator pedal 6. The clutch 24 is connected with the actuator 18. When the main control unit 10 is in normal operation, the clutch 23 is turned off and the clutch 24 is turned on. Therefore, the actuator 18 is operated on the basis of an optimum value calculated by the main control unit 10. When the main control unit 10 malfunctions, the auxiliary control unit 11 takes the place of the main control unit 10, and a signal therefrom turns on the clutch 23 and turns off the clutch 24. Then, the opening angle of the throttle valve 2 is determined directly by the movement of the accelerator pedal 6, and fuel injection of the limited operation mode is performed. Therefore, the driver can drive his vehicle at a low output without stopping the engine. In the embodiment illustrated in FIG. 2, the main control unit 10 or the auxiliary control unit 11 gives control signals to a single injector 4 provided downstream from the throttle valve 2. This injector 4 may be replaced by an injector of the multi-point injection type. Alternatively, an auxiliary injector 5 of the single-point injection type may be disposed upstream from the throttle valve 2, the control signals of the auxiliary control unit 11 being delivered only to the auxiliary injector 5, as shown in FIG. 3. Each of the injectors 4 and 5 in FIGS. 1 to 3 is of an electromagnetic valve type adapted to adjust the amount of fuel injection by changing the time of valve opening by solenoid exciting current. Fuel is supplied through a regulator to the main injector 4. A sensor 15 on a return circuit detects the supply pressure of fuel, and excess fuel is returned through a relief valve 22 to a fuel tank (not shown).

As mentioned above, the main control unit 10 performs calculation on the basis of the various compensation factors (intake air temperature, engine cooling water temperature, etc.) to adjust the time of valve opening of the injector and determine the amount of air. Therefore, even in low-temperature starting, warming up, etc., it is possible to obtain an optimum amount of air and an optimum air fuel ratio by programming alone and without any additional devices. The auxiliary control unit 11 does not need any inputs from the compensation elements, and has only a minimum function for performing injection of the limited operation mode according to the movements of the accelerator pedal. Therefore, the auxiliary control unit 11 may be smaller in size and bit and less expensive than the main control unit 10.

Thus, according to the present invention, the auxiliary control unit, apart from the main control unit, is incorporated into the fuel feed system of the fuel priority type. When, for some reason, the main control unit malfunctions, the auxiliary control unit will activate to avoid the danger of the engine suddenly stopping, thereby making it possible to perform a low output operation of the limited operation mode. If the auxiliary control unit has the ability of detecting the abnormality of the main control unit, the main control unit will automatically be changed over to the auxiliary control unit at the time of such abnormality, and greater safety of vehicle operation is insured.

As many apparently widely different embodiments of the invention may be made without departing from the spirit and scope thereof, it is to be understood that the invention is not limited to the specific embodiments thereof except as defined in the appended claims.

What is claimed is:

1. A fuel feed system for an internal combustion engine, comprising a fuel injector and a main control unit having an electronic calculating function, and utilizing inputs from control elements such as a fuel command means for detecting the degree of movement of an accelerator pedal, an air flow sensing device within an intake conduit, encoder means connected to a throttle valve actuator, compensation means providing electric signals for said main control unit for comparison with memories programmed in advance on the basis of the functional relations between the parameters of said control elements and compensation elements, and a throttle valve actuated on the basis of a required amount of air calculated from fuel flow input so as to give an optimum amount of air; and an auxiliary control unit adapted to operate when the aforesaid main control unit is out of order, the shaft of said throttle valve having a coupling device actuated by a signal from said auxiliary control unit so that actuating of said accelerator pedal directly turns said throttle valve, whereby the engine performs at a low output level in a limited operation mode which insures minimum running.

2. A fuel feed system as claimed in claim 1, wherein said compensation elements are sensors for engine cooling water temperature, engine cylinder head temperature, engine rotational frequency, atmospheric temperature, atmospheric pressure, fuel feed line pressure, etc.

3. A fuel feed system as claimed in claim 1, wherein said air flow sensing device detects air flow through the pressure difference between portions before and after said throttle valve, or through electric output which is in proportion to air intake, or by utilizing frequency changes based on fluid density.

4. A fuel feed system as claimed in claim 1, wherein said intake conduit is divided into two passages, one passage being provided with a first throttle valve actuated by an actuator, the other passage being provided with a second throttle valve directly connected with the working arm of said accelerator pedal.

5. A fuel feed system as claimed in claim 1 or 4, wherein said throttle valve shaft further has means for controlling the opening angle of the throttle valve.

6. A fuel feed system as claimed in claim 1, wherein said throttle valve within said intake conduit is provided at both ends of its shaft with coupling devices, one coupling device being connected with said throttle valve actuator, the other coupling device being connected with the working arm of said accelerator pedal, said one device being turned off and said other device being turned on by a signal from said auxiliary control unit when said main control unit is out of order.

7. A fuel feed system as claimed in claim 1, wherein one fuel injector controlled by said main control unit is provided either downstream from said throttle valve or within each conduit of an intake manifold.

8. A fuel feed system as claimed in claim 1, wherein a fuel injector controlled by said auxiliary control unit is provided either upstream or downstream from said throttle valve.

* * * * *